US008225636B2

(12) United States Patent
Borwig et al.

(10) Patent No.: US 8,225,636 B2
(45) Date of Patent: Jul. 24, 2012

(54) APPARATUS FOR FORMING A DUCT

(75) Inventors: Michael C. Borwig, Swisher, IA (US); Scott Sloan, Cedar Rapids, IA (US); Richard Burkart, Swisher, IA (US); Steven Kerska, Cedar Rapids, IA (US); John Welty, Kimball, MI (US)

(73) Assignee: Mestek Machinery, Inc., Westfield, MA (US)

( * ) Notice: Subject to any disclaimer, the term of this patent is extended or adjusted under 35 U.S.C. 154(b) by 159 days.

(21) Appl. No.: 12/851,117

(22) Filed: Aug. 5, 2010

(65) Prior Publication Data

US 2011/0030446 A1 Feb. 10, 2011

Related U.S. Application Data

(60) Provisional application No. 61/231,801, filed on Aug. 6, 2009.

(51) Int. Cl.
*B21D 5/04* (2006.01)

(52) U.S. Cl. ..... 72/176; 72/306

(58) Field of Classification Search ..... 72/176, 72/306, 307, 387, 405.01, 405.05, 405.09, 72/405.11, 420, 421, 422
See application file for complete search history.

(56) References Cited

U.S. PATENT DOCUMENTS

| | | | | |
|---|---|---|---|---|
| 3,147,791 | A | 9/1964 | Rauen et al. | |
| 4,044,658 | A | 8/1977 | Mitchard | |
| 5,105,640 | A | 4/1992 | Moore | |
| 5,405,240 | A | 4/1995 | Uno | |
| 6,640,600 | B2 * | 11/2003 | Meinert | 72/306 |
| 2009/0084152 | A1 | 4/2009 | Borwig et al. | |

OTHER PUBLICATIONS

International Search Report dated Sep. 23, 2010 from corresponding PCT Application No. PCT/US2010/02188.

* cited by examiner

*Primary Examiner* — Faye Francis
(74) *Attorney, Agent, or Firm* — McCormick, Paulding & Huber LLP

(57) ABSTRACT

An apparatus for forming a duct includes a bending apparatus and a support apparatus. The bending apparatus includes a table, a cut off beam, and a leaf hinged to a forward edge of the table. The cut off beam is movable toward and away from the table to clamp or release a metal web being fed forward across the table and the leaf. The cut off beam repeatedly clamps the metal web to the table while the leaf pivots toward the cut off beam to form a duct section. The support apparatus includes a cross rod movable along pivoting support arms. As the metal web is bent to form the duct section, the support arms and the cross rod are moved to internally support the duct section.

9 Claims, 9 Drawing Sheets

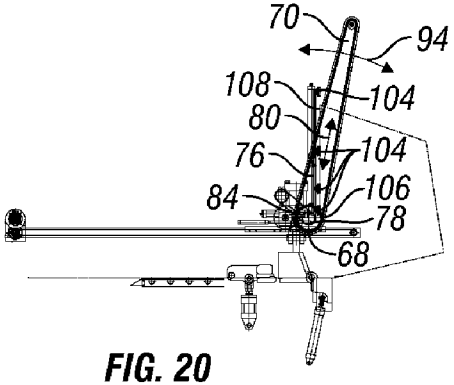
FIG. 20
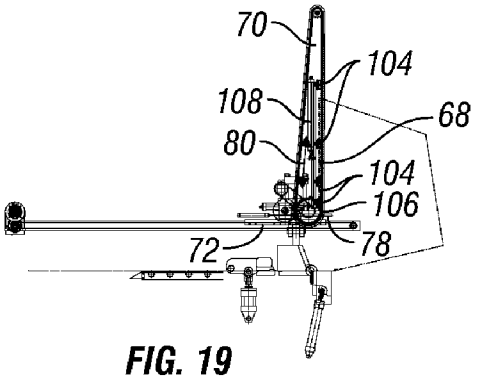
FIG. 19
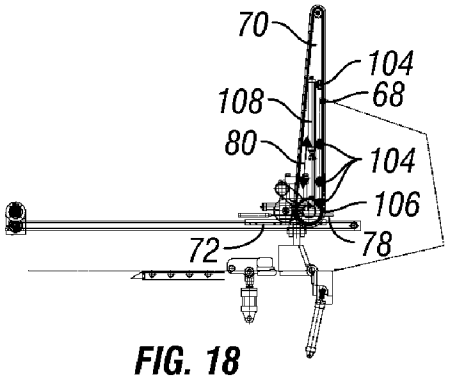
FIG. 18
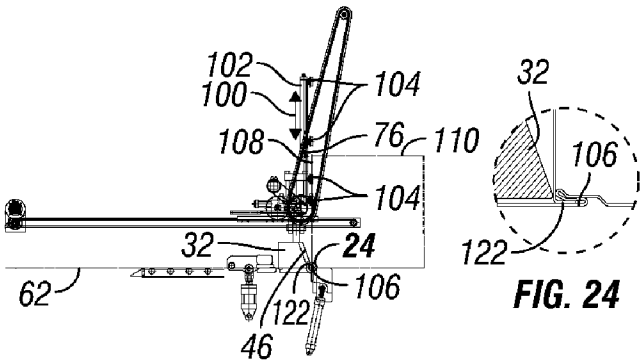
FIG. 23
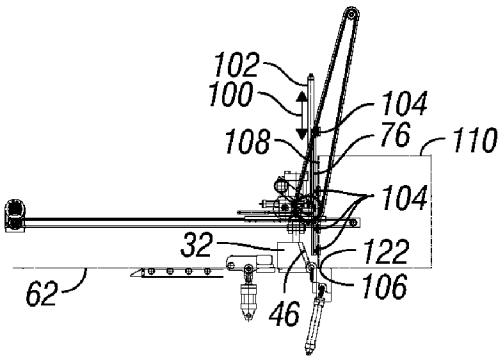
FIG. 22
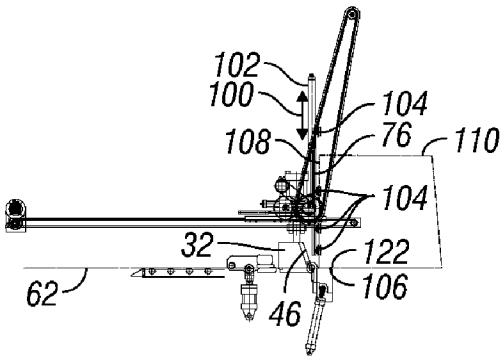
FIG. 21
FIG. 24

APPARATUS FOR FORMING A DUCT

CROSS REFERENCE TO RELATED APPLICATIONS

The present application claims priority to U.S. Provisional Patent Application Ser. No. 61/231,801, hereby incorporated herein by reference in its entirety.

FIELD OF THE INVENTION

The present invention relates generally to metal working apparatus and methods, and more particularly, to an apparatus and method for bending sheet metal to form ventilation ducts.

BACKGROUND OF THE INVENTION

With known apparatuses for manufacturing ventilation ducts and the like, a series of bends are made in a metal web to form a duct section. The duct section then is closed by one or more seams extending the length of the duct section. The seams can be folded or welded shut.

A seam can be pre-formed by bending and aligning free edges of the partially formed duct. However, known seams must be clamped, backstopped, or otherwise supported from an inner surface of the duct section in order to properly apply the forces required for adequate closure. Such clamping is not easily provided in-line with apparatus for bending the duct section. Thus, the duct section typically is removed from the bending apparatus to another work station for final closure of the seam. Removal of the duct section to the other work station requires extra steps for handling and aligning the duct section in the other work station. These extra steps reduce the efficiency of production.

Once the duct section is removed from the bending apparatus, the seam can be closed by repeatedly banging a hammer against the free edge of the seam. However, the repeated impacts of the hammer are noisy and tend to deform the metal along the seam. Alternatively, Welty (U.S. Pat. No. 5,189,784 hereby incorporated herein by reference in its entirety) discloses an apparatus for forming and closing seams in box-shaped ducts. However, Welty's previous apparatus is not adapted for use in-line with other machinery. In particular, manual handling is required to properly position a duct section relative to Welty's clamps and rollers. Thus, Welty's previous apparatus, although a significant advance in the art of its day, does not perfectly optimize efficiency of production.

In view of the continuous improvement in the art of making ducts from sheet metal, it is desirable to provide yet further improvements in forming and handling a duct section.

BRIEF SUMMARY OF THE INVENTION

In view of the above, it is a general object of the present invention to provide a duct making apparatus that pre-forms a seam as part of an inline manufacturing process to provide an ease of manufacture not present in known duct making systems.

It is another object of the present invention to form a duct section having a finished lock seam, without intermediate manual handling of the duct section.

It is another object of the present invention to internally support a duct section while the duct section is formed, so as to mitigate unnecessary deformation of duct section segments and of corners between the duct section segments.

In one embodiment, an apparatus for forming a duct comprises a bending apparatus, a support apparatus, and a controller directing and coordinating movement of the duct section bending and support apparatus. The bending apparatus includes a lower platen, an upper platen that can be raised away from the lower platen and lowered toward the lower platen, a table that can be moved toward and away from the lower platen vertically and horizontally, a cut off beam that can be moved vertically toward and away from the table, and a leaf that can be moved vertically and pivotally with reference to the table. A metal web is fed forward across the lower platen and the table onto the leaf. The support apparatus includes a slide carriage, a linear rail supporting the slide carriage, two opposed support arms pivotally mounted to the slide carriage and movable around a horizontal axis perpendicular to the forward motion of the metal web, and a cross bar extending horizontally between the two support arms.

In one embodiment, the controller is configured to automatically direct the motions of the bending apparatus so as to bend a metal web into the form of a duct section comprising multiple segments joined by a lock seam to form a closed profile. The controller also is configured to control and coordinate the motions of the support apparatus with the bending apparatus so as to internally support the duct section while the segments are formed, so as to grip a forward segment of the duct section for insertion into the lock seam, and so as to withdraw from the duct section while the bending apparatus forms a pre-bend to secure the lock seam.

These and other objects, features, and advantages of the present invention will be better understood in view of the Figures and preferred embodiment described.

BRIEF DESCRIPTION OF THE DRAWINGS

FIGS. 5-30 are sequential side schematic views illustrating an operating method of the improved duct forming apparatus shown in FIGS. 2-4.

DETAILED DESCRIPTION OF PREFERRED EMBODIMENTS

Figure 1A:
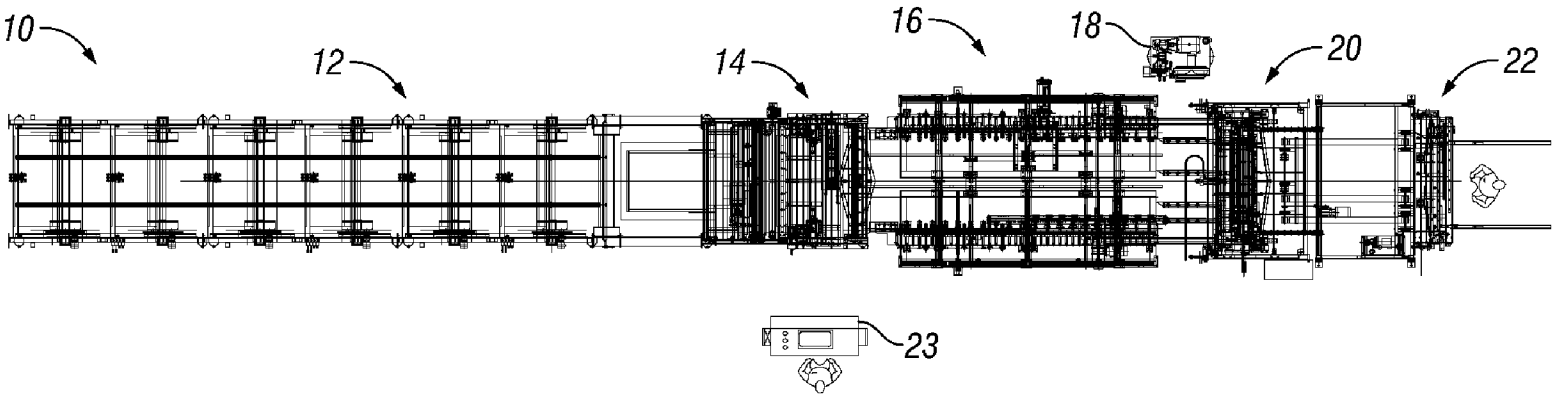
FIGS. 1A and 1B are plan and side elevation views of an apparatus for forming a duct, including an improved duct forming apparatus according to an embodiment of the present invention.
Figure 1B:
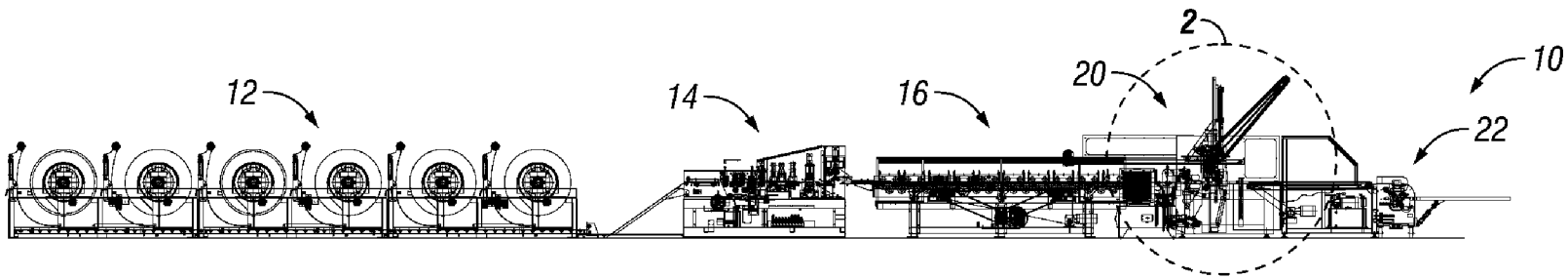

An apparatus for forming a duct 10, as shown in FIGS. 1A and 1B, includes a series of uncoilers 12, a roll feeder 14 or similar means for feeding a metal web from the uncoilers forward through the apparatus for forming a duct, a rollformer 16, a hydraulic power unit 18, an improved duct forming apparatus 20, and a seam finisher 22, all mounted on a common base. A control unit 23 is operably connected to the notcher and feeder, the rollformer, and the improved duct forming apparatus for coordinating motions thereof. For example, in the embodiment shown in FIGS. 1A and 1B, the control unit sequentially directs hydraulic fluid, compressed air, and/or electrical power to various portions of the apparatus for forming a duct so as to accomplish the movements described below with reference to FIGS. 2 and 5-30.

Rolls of sheet metal are mounted into the uncoilers and are sequentially uncoiled to provide a metal web, which is fed from left to right through the notcher and feeder, the roll-former, and the improved duct forming apparatus and is operated upon by each of these subassemblies. Throughout the following detailed description of drawings, the direction "forward" refers to a normal advancing motion of the sheet metal from left to right in the drawings; the direction "rearward" refers to a retracting motion of the sheet metal from right to left.

Figure 2:
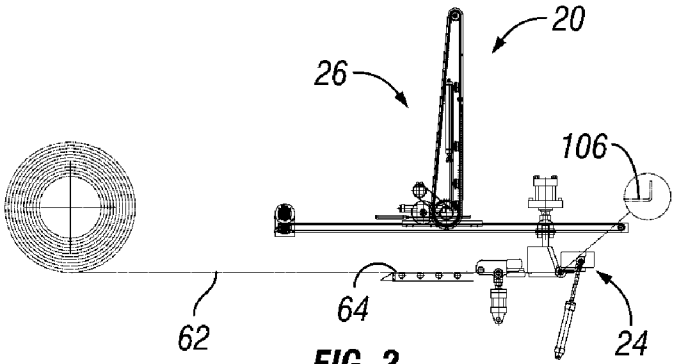
FIG. 2 is a side schematic view of the improved duct forming apparatus shown in FIGS. 1A and 1B, comprising a bending apparatus and a support apparatus, according to an embodiment of the present invention.

Referring to FIG. 2, the improved duct forming apparatus 20 includes a bending apparatus 24 and a support apparatus 26.

Figure 3:
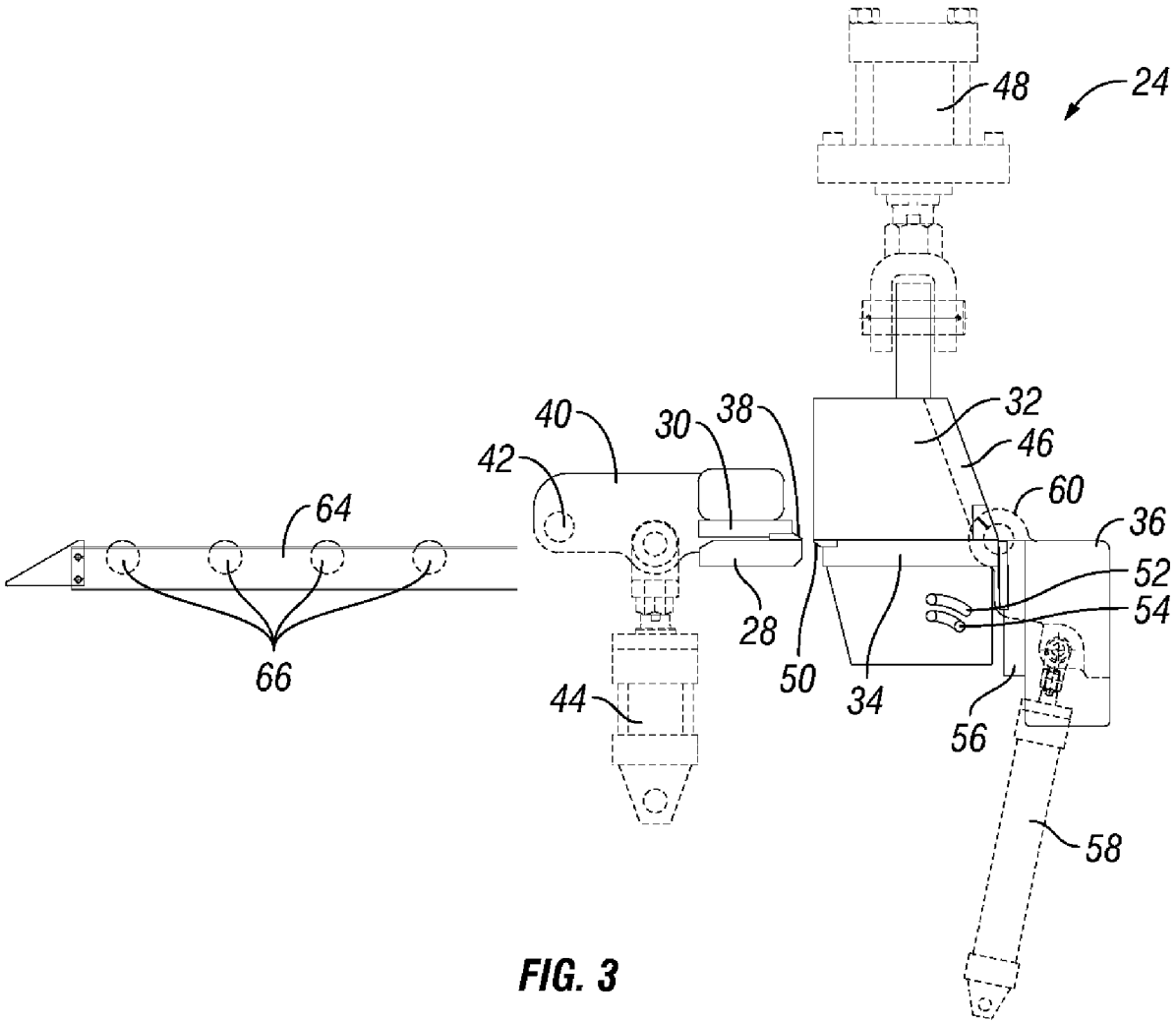
FIG. 3 is a side schematic view of the bending apparatus of FIG. 2.

Referring to FIG. 3, the bending apparatus 24 includes a platen assembly including a lower platen 28 and an upper platen 30, and also includes a table assembly including a cut off beam 32, a table 34, and a leaf 36. The lower platen is fixed to the base of the apparatus for forming a duct. The upper platen has an upper platen beak 38 mounted at a lower forward edge thereof, and is mounted to an upper platen arm 40. The upper platen arm is pivotally movable about an upper platen axle 42 by an upper platen ram 44. The upper platen axle and the upper platen ram are mounted to the base of the apparatus for forming a duct. The cut off beam includes an upper shear blade 46 and is vertically movable relative to the table by means of a cut off ram 48. The table includes a table tail 50 formed at an upper rearward edge thereof. The table is vertically and horizontally movable relative to the base along a curved path illustrated by guide pins 52 and curved slots 54. The table tail is disposed so that a lower face of the table tail closely approaches an upper face of the upper platen beak when the table is moved to its furthest upward and rearward position. The leaf includes a lower shear blade 56 and is movable relative to the table by way of a leaf ram 58. The lower shear blade is slidably connected to the leaf and can be extended beyond an upper surface of the leaf, or retracted flush with the leaf, by a geared rack or other actuator (not shown). Extension of the leaf ram ordinarily causes the leaf to pivot upwards around a hinge 60 mounted to an upper forward corner of the table. However, the hinge can be detached to permit sliding vertical motion of the leaf along a forward face of the table. A metal web 62 enters the bending apparatus across a feed tray 64, which has a plurality of rollers 66 for supporting the metal web. The metal web then passes between the upper platen and the lower platen, between the cut off beam and the table, and onto the leaf.

Figure 4:
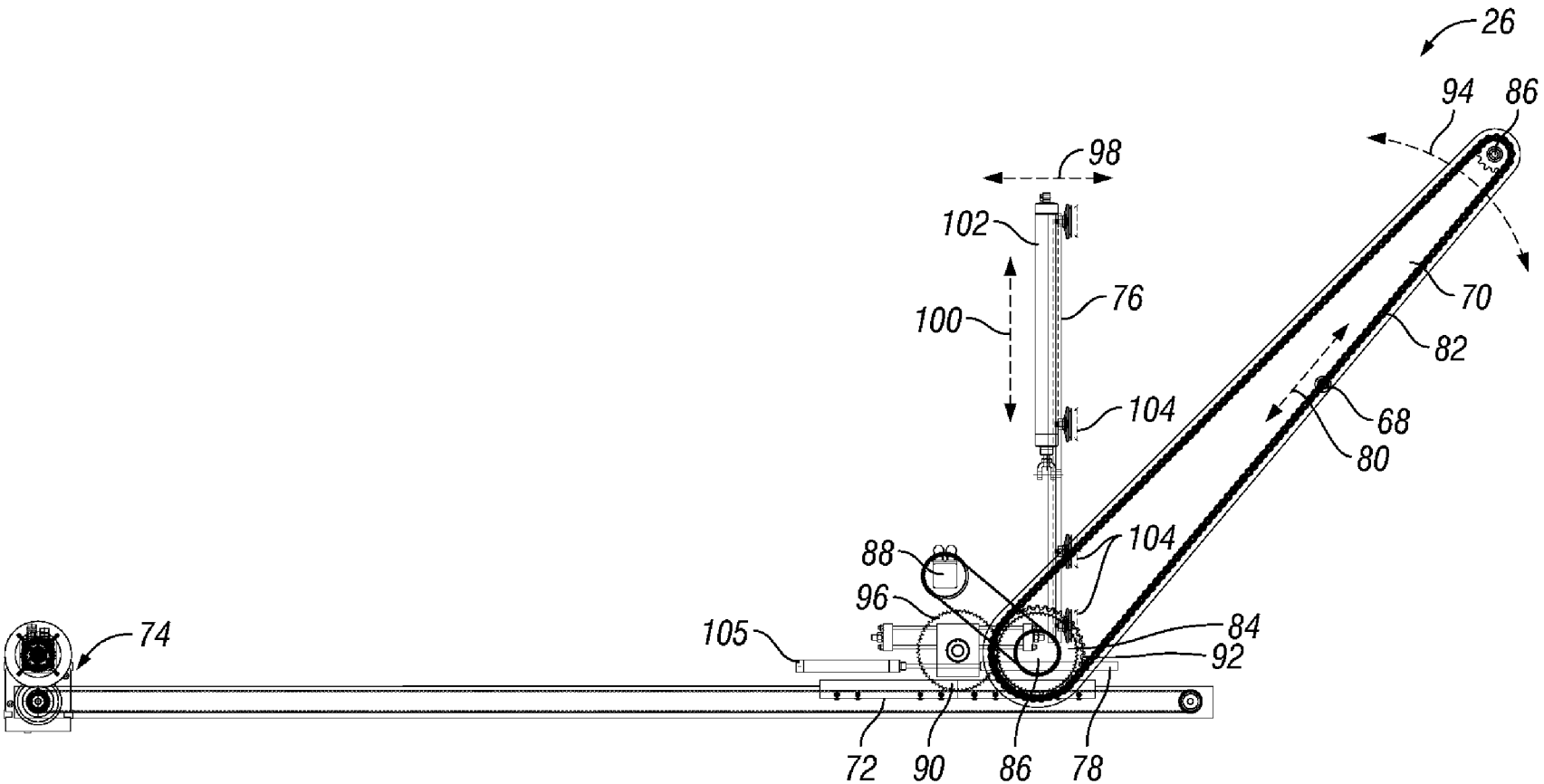
FIG. 4 is a side schematic view of the support apparatus of FIG. 2.

Referring to FIG. 4, the support apparatus 26 includes a cross rod 68, which extends between two opposed support arms 70 transverse to the metal web 62. The support arms are mounted to a slide carriage 72, which is mounted on a motorized linear rail 74 extending substantially parallel to the metal web. The motorized linear rail is fixedly mounted to the base of the apparatus for forming a duct. The slide carriage also supports a gripper assembly 76, which extends upward from a point near the pivot axis of the support arms, and three support rod assemblies 78.

The cross rod 68 is movable on the support arms 70 along and around an elongated oval path 80. In the embodiment shown in FIG. 4, the cross rod is movably mounted to the support arms on a drive chain 82 having forward and rearward portions extending around a cross rod drive gear 84 and a cross rod pinion 86. The cross rod drive gear is driven by a servo motor 88, either directly, by gearing, or by means of a belt or chain as shown in FIG. 4.

The support arms 70 are pivotally mounted to the slide carriage 72 on a support arm pinion 90. The support arm pinion is meshed with a pivot drive gear 92. Mutual rotation of the pivot drive gear and the support arm pinion moves the support arms relative to the slide carriage as shown by the curved path 94. The pivot drive gear can be moved by the rack, pinion, and bull gear 96 as shown in FIG. 4, or by other suitable means such as a pneumatic cylinder.

The slide carriage 72 is movable along the motorized linear rail 74 as shown by the arrow 98, and supports the other components of the support apparatus 26.

Figure 31:
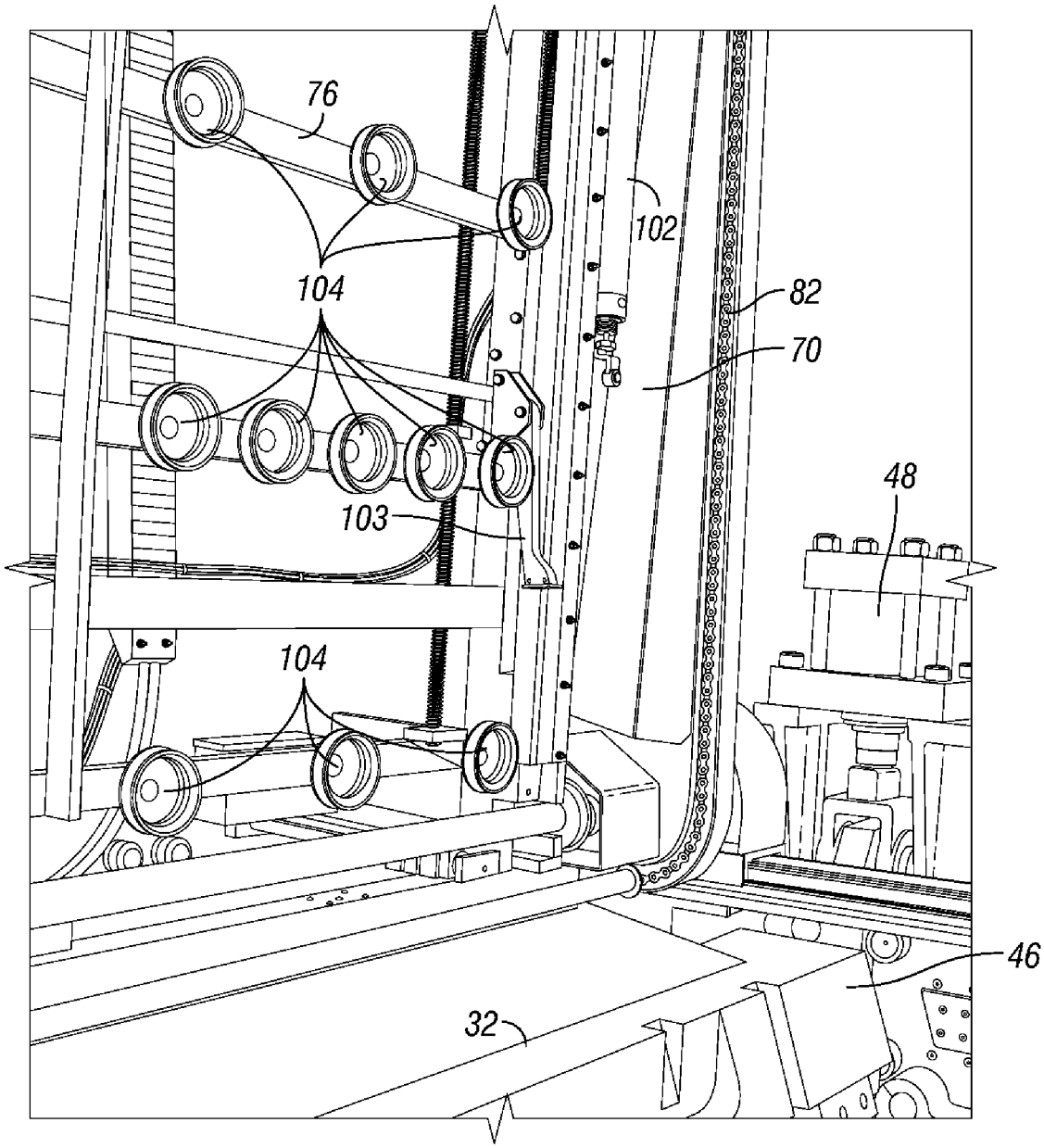
FIGS. 31-32 are perspective views of the support apparatus shown in FIGS. 2-30.
Figure 32:
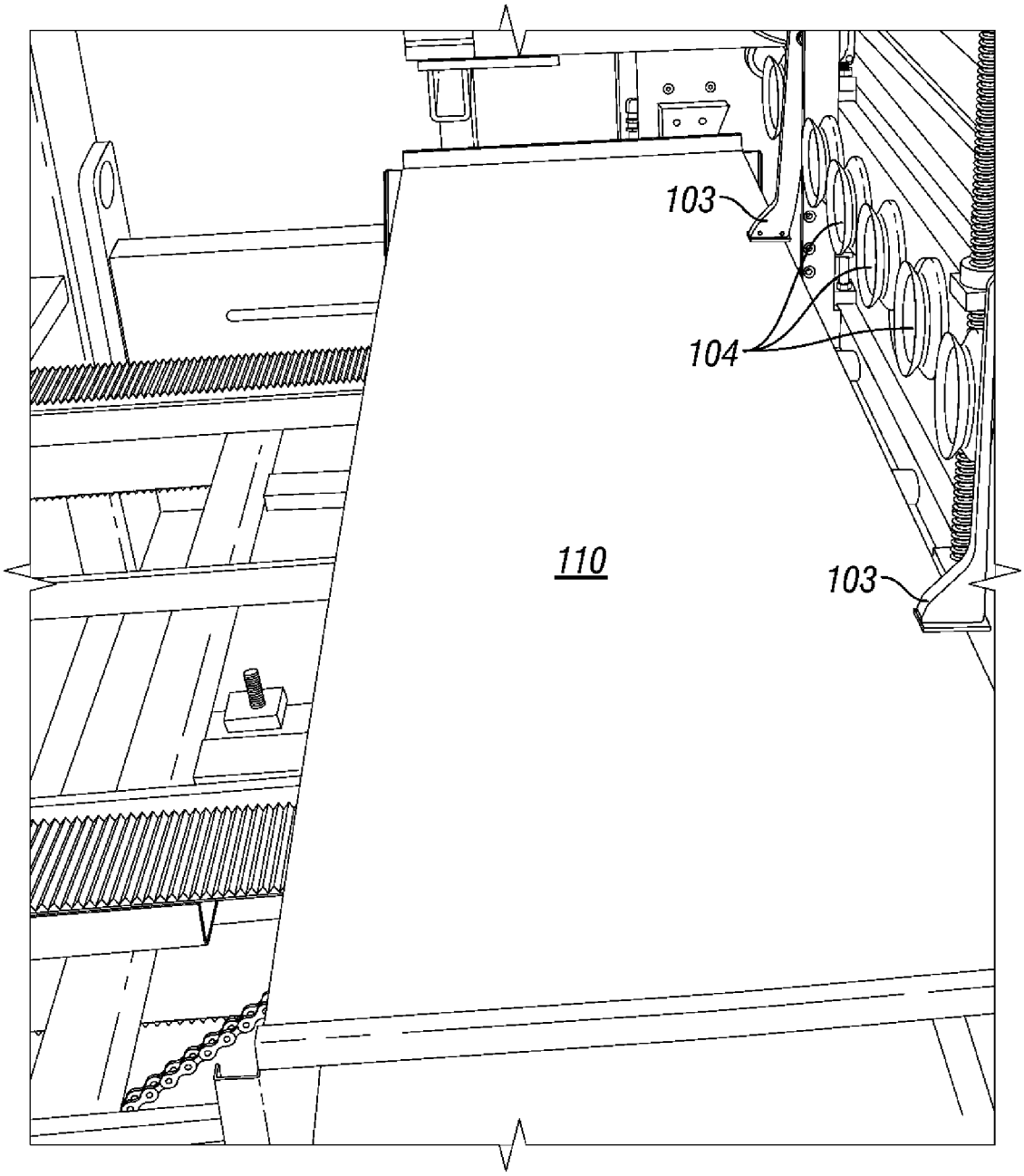

The gripper assembly 76 is movable with reference to the slide carriage 72, as shown by the arrow 100, by a vertical pneumatic ram 102 connected between the slide carriage and the gripper assembly. The gripper assembly includes web holders for holding an outer surface of the web, such as vacuum cups 104, along with associated vacuum hoses and valves (not shown). For use specifically with magnetizable materials, the gripper assembly can include electromagnet web holders with associated wiring. Additionally, for handling small-section ducts, the gripper assembly can include spring loaded boots 103 that can extend above an upper side of a small duct section (as further discussed below with reference to FIGS. 21-23, and as shown in FIGS. 31 and 32), but that are pushed in by the adjacent vertical side of a larger duct section.

The support rods 78 are movably mounted to the slide carriage 72 by way of support rod cylinders 105, which can extend and retract the support rods substantially parallel to the motorized linear rail 74.

In operation, the control unit 23 coordinates motions and positions of all movable parts. As shown in FIG. 2, the upper platen 30 and the leaf 36 start in raised positions that permit the metal web 62 to be freely fed across the feed tray 64, the lower platen 28, and the table 34 onto the leaf 36. The leaf 36 starts in a horizontal) (0°) position for receiving a forward portion of the metal web, and then is pivoted upward by the leaf ram 58 to form a lock tab 106 at the forward edge of the metal web.

Figure 5:
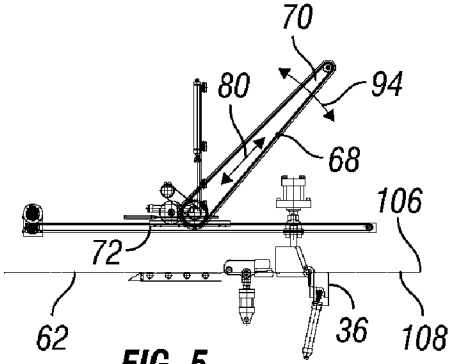

As shown in FIG. 5, after forming the lock tab 106, the leaf 36 swings down and the metal web 62 is fed forward to a position for forming a first duct section segment 108. The support arms 70 pivot downward along the path 94 and the cross rod 68 moves toward the slide carriage 72 along the path 80, into a clearance position where the cross rod will not interfere with bending the first duct section segment.

Figure 6:
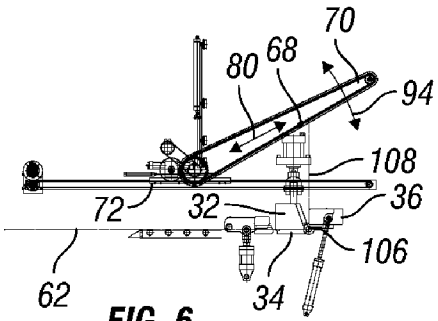

Referring to FIG. 6, the cut off beam 32 is lowered to clamp the metal web 62 against the table 32. The leaf 36 swings up to a vertical)(90°) position to form the first duct section segment 108. The support arms 70 pivot further down the path 94, and the cross rod 68 moves away from the slide carriage 72 along the path 80, so that the cross rod engages the inside corner formed by the lock tab 106 and the first duct section segment 108.

Figure 7:
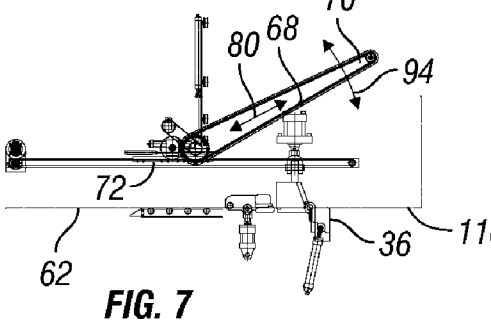

Then, as shown in FIG. 7, the leaf 36 swings down to a horizontal) (0°) position. The metal web 62 is fed forward to a position for forming a second duct section segment 110. The cross rod 68 is retracted toward the slide carriage 72 along the path 80 and the support arms 70 pivot further downward on the path 94.

Figure 8:
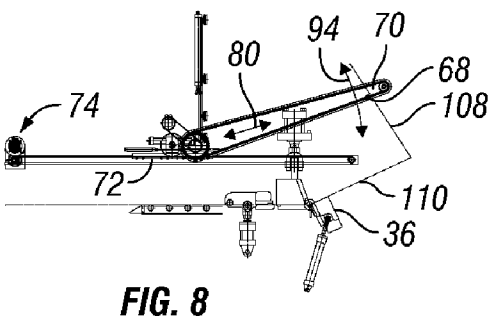
Figure 9:
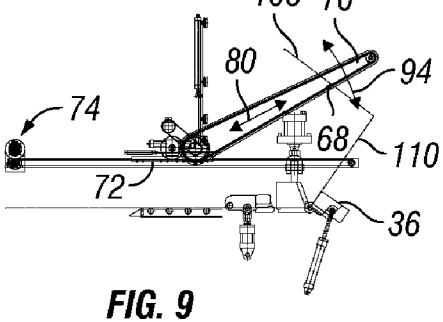
Figure 10:
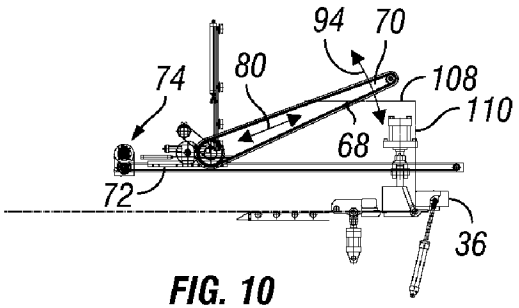

Referring to FIGS. 8-10, as the leaf 36 pivots upward to form the second duct section segment 110, the support arms 70 and the cross rod 68 respectively pivot on the curved path 94 and move along the oval path 80, and the slide carriage 72 is retracted along the motorized linear rail 74, so as to continuously support the first duct section segment 108.

Figure 11:
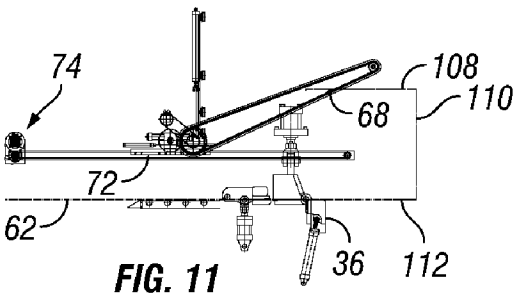

When the second duct section segment 110 has been formed, the leaf 36 pivots back to the horizontal position shown in FIG. 11. The metal web 62 is fed forward for forming a third duct section segment 112. The slide carriage 72 is advanced on the linear rail 74 to match the motion of the metal web, so that the cross rod 68 continues to support the first duct section segment 108.

Figure 12:
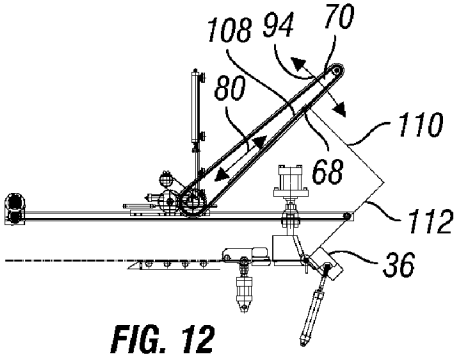

Referring to FIG. 12, as the leaf 36 pivots to the vertical position, forming the third duct section segment 112, the cross rod 68 is advanced along the oval path 80 and the support arms 70 pivot upward on the curved path 94 so that the cross rod 68 continuously supports the inside corner defined by the first duct section segment 108 and the second duct section segment 110.

Figure 14:
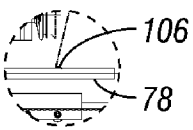
Figure 13:
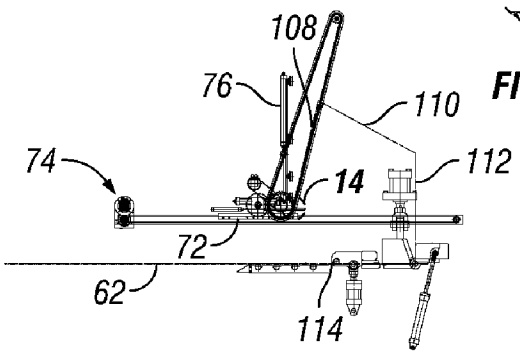

When the third duct section segment 112 has been formed, as shown in FIGS. 13 and 14, the lock tab 106 rests on the support rods 78 and the first duct section segment 108 is bent toward the third duct section segment 112 by contact with the gripper assembly 76. As the metal web 62 is fed forward for forming the closing segment 114, the slide carriage 72 is advanced along the motorized linear rail 74 so as to continuously support the first and second duct section segments 108, 110.

Figure 16:
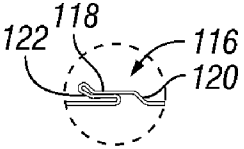
Figure 15:
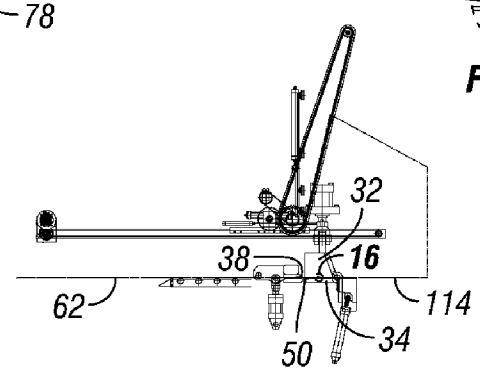

Referring to FIGS. 15 and 16, the cut off beam 32 and the table 34 move together around the upper platen beak 38 so that the upper platen beak and the table tail 50 form a Z-fold 116 in the metal web 62 at a rearward end of the closing segment 114. A lock seam 118, including an offset 120 and an insertion angle 122, then is formed on the Z-fold according to methods and apparatus more fully described in co-pending and commonly assignable U.S. patent application Ser. No. 12/243,489 (filed Oct. 1, 2008) and U.S. patent application Ser. No. 12/511,125 (filed Jul. 29, 2009), of which relevant portions hereby are incorporated herein by reference.

Figure 17:
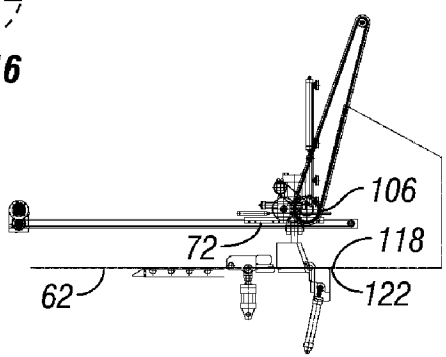

Referring to FIG. 17, the metal web 62 is advanced while the slide carriage 72 remains stationary, so that the lock tab 106 is horizontally positioned for insertion into the insertion angle 122 of the lock seam 118.

Referring to FIGS. 18 and 19, the cross bar 68 and the support arms 70 move so that the first duct section segment 108 is pressed against the vacuum cups 104 while the lock tab 106 remains supported on the support rods 78. The cross rod then is retracted along the oval path 80 toward the slide carriage 72. As the cross rod passes each vacuum cup, the vacuum cups are activated to hold the first duct section segment.

As shown in FIG. 20, when the cross rod 68 reaches the inside corner defined by the lock tab 106 and the first duct section segment 108, the support rods 78 are retracted. The first duct section segment now is supported and held in horizontal position by the vacuum cups 104. The support arms 70 pivot about ten degrees) (10°) downward along the curved path 94, and the cross rod is retracted along the oval path 80 around the cross rod drive gear 84, to a position rearward of the gripper assembly 76.

Referring to FIGS. 21-23, the vertical ram 102 extends to move the gripper assembly 76 downward along the path 100, just forward of the upper shear blade 46. When the lock tab 106 is vertically aligned with the insertion angle 122, the metal web 62 is retracted to force the lock tab into the insertion angle. The vacuum cups 104 release the first duct section segment 108, and the gripper assembly is retracted upwards. Alternatively, for smaller ducts, the spring loaded boots 103 press down on the second duct section segment 110 while the front face 46 of the cut off beam 32 presses forwardly on the first duct section segment.

As shown in FIG. 24, the metal web is retracted further so that the cut off beam 32 firmly presses the lock tab 106 into the insertion angle 122.

Figure 25:
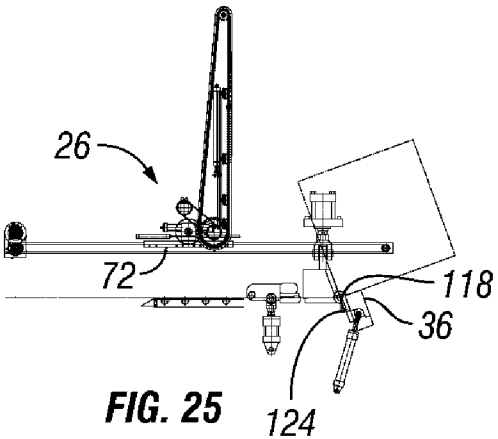

Referring to FIG. 25, while the slide carriage 72 and the rest of the duct section support assembly 26 reset to starting positions, the leaf 36 pivots upward to make a twenty degree) (20°) pre-bend 124 of the lock seam 118.

Figure 26:
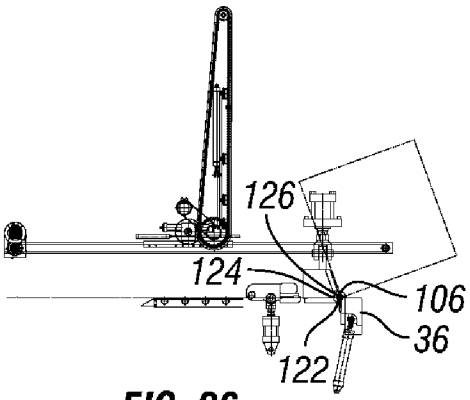

Referring to FIG. 26, once the pre-bend 124 has been made, the leaf 36 pivots down to the horizontal position and the metal web is advanced slightly (about seven sixteenths of an inch (7/16")) for forming a clinch tab 126 for retaining the lock tab 106 in the insertion angle 122.

Figure 27:
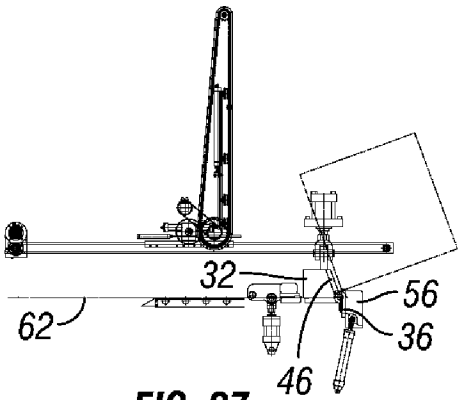
Figure 28:
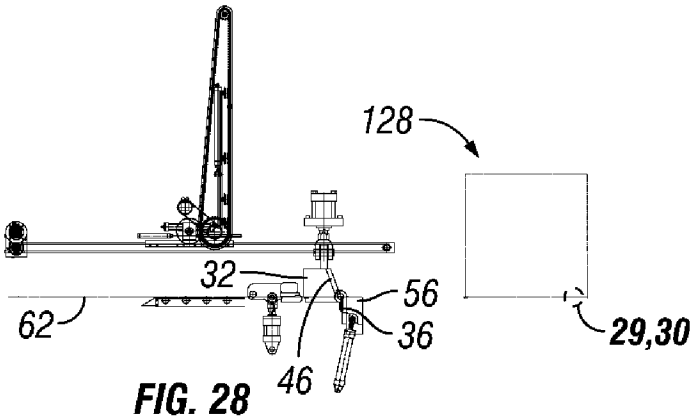

As shown in FIGS. 27-28, the cut off beam 32 moves downward and the lower shear blade 56 is extended upward from the leaf 36 so that the upper and lower shear blades 46, 56 sever the metal web 62 to form the clinch tab 126 and to separate a duct section 128 from the metal web. The leaf then slides down to the horizontal position and the duct section is moved off the leaf by a conveyor (shown generally in FIGS. 1A and 1B) for final closure of the lock seam 118 in the seam finisher 22.

Figure 30:
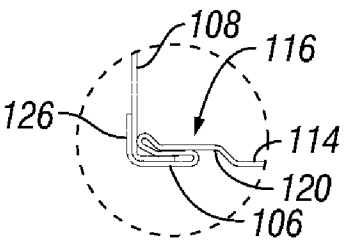
Figure 29:
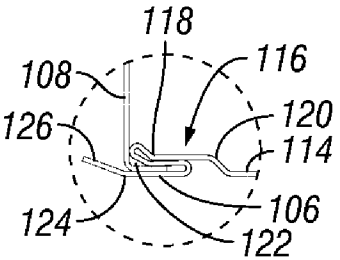

Referring to FIGS. 29 and 30, the pre-bend 124 prevents the lock seam 118 springing open as the duct section 128 moves down the conveyor or is otherwise moved to the seam finisher 22. After operation of the seam finisher, the clinch tab 126 is clinched flat against the first duct section segment 108, providing a smooth outer surface of the duct section.

One advantage of the present invention is that the pre-bend 124 permits handling the duct section 128 without separation of the lock seam 118. The pre-bend can be formed because the support apparatus 26 firmly holds the metal web 62 to permit accurate formation of corners defining the lock tab 106 and the duct section segments 108, 110, 112, 114 as well as the pre-bend, and because the support apparatus and the bending apparatus are coordinated in motion by the control unit 23 to firmly insert the lock tab into the insertion angle 122 of the lock seam. Additionally, the support apparatus, with the cross rod 68 being movably mounted on the pivoting support arms 70, solves a long-standing problem of how to support the entirety of a duct section from the inside during an in-line manufacturing process.

Although this invention has been shown and described with respect to the detailed embodiments thereof, it will be understood by those skilled in the art that various changes in form and detail thereof may be made without departing from the spirit and the scope of the invention.

What is claimed is:

1. An apparatus for forming a duct from a metal web moving along a path defined by said apparatus and having a width across the path, said apparatus comprising:

a platen assembly including a first platen contacting one face of the web and including a second platen cooperatively movable with said first platen to alternately hold and release the web;

a table assembly including a table movable toward and away from said platen assembly along the path of the web, including a beam movably connected to said table for clamping and releasing the web, and further including a leaf hinged to a forward edge of said table, the leaf being pivotally movable to bend the web inwardly against a slanted forward face of the beam and also being vertically movable to shear the web against a lower forward corner of the beam; and a support assembly including a rod extending across the width of the web, the rod being movably mounted to one of said platen assembly or said table assembly for internally supporting an inward surface of the web during forming of the duct section and for removing the rod from the duct section prior to closing the duct section.

2. The apparatus as claimed in claim 1, further comprising a gripper assembly that includes a plurality of web holders for outwardly gripping a segment of the duct section.

3. The apparatus as claimed in claim 2, wherein said gripper assembly is movable toward and away from the path of the web for gripping and positioning a segment of the duct section.

4. The apparatus as claimed in claim 2, wherein said gripper assembly is movable along the path of the web for gripping and positioning a segment of the duct section.

5. The apparatus as claimed in claim 2, wherein the web holders of said gripper assembly are arranged in a plane transverse the path of the web.

6. The apparatus as claimed in claim 1, wherein the rod of said support assembly is movable along an oval path toward and away from the web and parallel the path of the web.

7. The apparatus as claimed in claim 6, wherein the oval path of said support assembly is pivotally movable about an axle transverse the path of the web.

8. The apparatus as claimed in claim 7, wherein the axle of said support assembly is movable parallel to the path of the web.

9. The apparatus as claimed in claim 1, wherein said support assembly also includes a plurality of second rods, each of which can be extended and retracted parallel to the path of the web.

* * * * *